United States Patent [19]

Ura et al.

[11] Patent Number: 5,017,900

[45] Date of Patent: May 21, 1991

[54] DEFLECTION YOKE

[75] Inventors: Mitugu Ura; Yoshihiro Obara, both of Mizusawa; Kazushi Takahashi, Ichinoseki, all of Japan

[73] Assignee: Hitachi Mizusawa Electronics Co., Ltd., Mizusawa, Japan

[21] Appl. No.: 479,760

[22] Filed: Feb. 9, 1990

[30] Foreign Application Priority Data

Feb. 10, 1989 [JP] Japan ..... 64-29908
Dec. 19, 1989 [JP] Japan ..... 64-327320

[51] Int. Cl.[5] ..... H01F 5/00

[52] U.S. Cl. ..... 335/210; 335/211; 313/440

[58] Field of Search ..... 335/210, 211, 212, 213, 335/214; 313/429, 430, 431, 440

[56] References Cited

U.S. PATENT DOCUMENTS 4,853,588 8/1989 Ohtsu et al. ..... 335/213 X 4,882,521 11/1989 Arimoto ..... 335/213 X

*Primary Examiner*—George Harris

*Attorney, Agent, or Firm*—Wegner, Cantor, Mueller & Player

[57] ABSTRACT

A deflection yoke is constructed of a truncated conical hollow core, a pair of saddle-shaped horizontal deflection coils disposed inside the core, and a pair of toroidal vertical deflection coils wound on the core or a pair of vertical deflection coils wound in a saddle-like configuration and arranged in the vicinity of the core. A pair of cancellation coils opposing each other on an imaginary axis which passes through a central axis of the core in the direction of vertical deflection are arranged near front end sections of the vertical deflection coils, respectively. A central axis of each of said cancellation coils is inclined at a predetermined angle relative to the central axis of the core. The cancellation coils are connected with the horizontal deflection coils, respectively.

14 Claims, 6 Drawing Sheets

DEFLECTION YOKE

BACKGROUND OF THE INVENTION (a) Field of the Invention

The present invention relates to a deflection yoke suitable for use, for example, in a video display or a video game, and especially to a means for effectively reducing electromagnetic interference radiation produced from a deflection yoke.

(b) Description of the Related Art

Sources of electromagnetic interference radiation in a video display or the like include a deflection yoke, a flyback transformer and other coils. Of these, the primary source is the deflection yoke.

The electromagnetic interference radiation from a deflection yoke is a magnetic field induced by a current of sawtooth waveform which flows through each horizontal deflection coil during each horizontal retrace interval. Various methods have been proposed with a view toward preventing the occurrence of electromagnetic interference radiation from a deflection yoke. One example is disclosed in Japanese Patent Laid-Open No. 82633/1987.

The invention described in the above patent publication is concerned with the elimination of electromagnetic interference radiation which is produced from the fringe of the front end section (end portion on the screen side of a cathode ray tube) and from the fringe of the rear end section (end section on the neck side of the cathode-ray tube) of each saddle-shaped horizontal deflection coil. Described specifically, the invention of the above patent publication features the use of cancellation coils having a substantially similar saddle-like shape to the horizontal deflection coils but only 3–10% of the number of turns of the horizontal deflection coils. The cancellation coils are connected in series with the corresponding horizontal deflection coils, so that magnetic fields, namely, those electromagnetic interference radiations produced from the fringes of the front and rear end sections of each horizontal deflection coil, may be canceled by magnetic fields produced from the fringes of the front and rear end sections of the corresponding cancellation coil.

The above conventional technique can eliminate electromagnetic interference radiation produced from both the front and rear fringes of the horizontal deflection coil, but electromagnetic interference radiation also occurs from the front and rear end sections of each horizontal deflection coil other than the fringes. In front of the cathode-ray tube, electromagnetic interference radiation from the front end section of each horizontal deflection coil other than the corresponding front end fringe is of primary concern rather than that produced from the front end fringe.

The above-described conventional method can reduce electromagnetic interference radiation from each front end section to a certain extent. However, any attempt to reduce the radiation further however results in more electromagnetic interference radiation from each rear end section.

Production of electromagnetic interference radiation from the deflection yoke will hereinafter be described with reference to FIG. 9 which appears next to FIG. 3.

Horizontal deflection coils 1,1' and vertical deflection coils 2,2' are provided in association with an unillustrated cathode-ray tube. When a deflection current of sawtooth waveform is caused to flow through the horizontal deflection coils 1,1', a magnetic field (hereinafter called the "primary magnetic field") 6 is projected ahead from front end sections (end sections on the screen side of the cathode-ray tube) of the horizontal deflection coils 1,1' as indicated by solid arrow marks. In addition, another magnetic field (hereinafter called the "front end fringe magnetic field") 5 is also projected ahead from fringes (hereinafter called the "front end fringes") of front end sections of the horizontal deflection coils 1,1' as indicated by dashed arrow marks. The front end fringe magnetic field 5 is a backing magnetic field relative to the primary magnetic field 6.

On the neck side of the unillustrated cathode ray tube, a further magnetic field (hereinafter called the "secondary magnetic field") 9 is also projected behind from rear end sections of the horizontal deflection coils 1,1' as indicated by solid arrow marks. In addition, a still further magnetic field (hereinafter called the "rear end fringe magnetic field") 10 is also projected behind from fringes (hereinafter called the "rear end fringes") 8,8' of the rear end sections of the horizontal deflection coils 1,1' as indicated by solid arrow marks.

These primary magnetic field 6, front end fringe magnetic field 5, secondary magnetic field 9 and rear end fringe magnetic field 10 are all electromagnetic interference radiations. Since the horizontal deflection current varies considerably during each horizontal retrace interval, these electromagnetic interference radiations occur at substantially high intensities. In particular, the primary magnetic field 6 and the rear end fringe magnetic field 10 extend to substantial distances on the screen side and neck side of the cathode-ray tube, respectively.

Regarding electromagnetic interference radiation, how much the intensity of magnetic field would vary depending on the deflection current during each horizontal retrace interval is measured at a position remote over a predetermined distance from the cathode-ray tube. Each measurement value is expressed in terms of mT/sec. It has been recognized that the primary magnetic field 6 is dominant as electromagnetic interference radiation when measured at a point A remote over a predetermined distance from the screen of the cathode-ray tube in FIG. 9 and the rear end fringe magnetic field 10 is dominant as electromagnetic interference radiation when measured at a point B remote over a predetermined distance from the rear end of the cathode-ray tube on the other hand.

As described above, the magnetic field produced from the front end sections of the horizontal deflection coils 1,1' are dominant as electromagnetic interference radiation on the front side of the deflection yoke but the magnetic field produced from the rear end fringes of the horizontal deflection coils 1,1' is dominant as electromagnetic interference radiation on the rear side of the deflection yoke. At both the front end sections and the rear end sections of the horizontal deflection coils 1,1', the magnetic fields produced there are opposite in direction to the magnetic fields produced from the corresponding fringes.

It is therefore impossible to eliminate electromagnetic interference radiations produced from both the front end section and the rear end section of the horizontal deflection coils 1,1' by the above-described conventional technique which is intended to eliminate electromagnetic interference radiations produced from the fringes of both the front end section and the rear end section of the horizontal deflection coils 1,1'.

The cancellation coils described above are mounted near the front end section of the deflection yoke symmetrically relative to the central axis of the deflection yoke. When the deflection yoke is attached to a cathoderay tube and there is no external magnetic body, e.g., no magnetic shield plate around the cathode-ray tube, the magnetic fluxes produced from the cancellation coils become symmetrical so that the electromagnetic interference radiation can be suppressed around the entire periphery of the cathode-ray tube.

In an actual video display, the outer periphery of a chassis is however often covered by a magnetic shield plate to reduce electromagnetic interference radiation from components other than a deflection yoke. When the deflection yoke equipped with cancellation coils and attached to a cathode-ray tube is installed within the video display and the intensity of electromagnetic interference radiation is measured, the intensity of electromagnetic interference radiation is found to be higher at certain locations due to the arrangement of the magnetic shield plate. There is hence the potential danger that deleterious effects may be given to the human body.

SUMMARY OF THE INVENTION

A first object of the present invention is to overcome such drawbacks of the conventional techniques and to provide a deflection yoke which can fully reduce electromagnetic interference radiation at all locations therearound.

A second object of the present invention is to overcome such drawbacks of the conventional techniques and to provide a deflection yoke which produces extremely little electromagnetic interference radiation even when a magnetic shield plate or the like is arranged near the deflection yoke.

To achieve the first object, the present invention provides a deflection yoke comprising a truncated conical hollow core, a pair of saddle-shaped horizontal deflection coils disposed inside said core, and a pair of toroidal vertical deflection coils wound on said core or a pair of vertical deflection coils wound in a saddle-like configuration and arranged in the vicinity of said core. A pair of cancellation coils opposing each other on an imaginary axis which passes through a central axis of said core in the direction of vertical deflection are arranged near front end sections of said vertical deflection coils, respectively. A central axis of each of said cancellation coils is inclined at a predetermined angle relative to the central axis of said core. Said cancellation coils are connected with said horizontal deflection coils, respectively.

Further, to attain the second object, the present invention also provides a deflection yoke assembly comprising in combination a deflection yoke with a core, a plurality of cancellation coils arranged near a front end section of said core to cancel magnetic fields produced from said front end section and a rear end section of said deflection yoke, and a magnetic-flux-distribution-unbalancing member disposed near said deflection yoke to unbalance the state of distribution of magnetic fluxes produced respectively from said cancellation coils. At least one of said cancellation coils, said one cancellation coil being arranged in the vicinity of said unbalancing member, is different in magnetic flux intensity from at least one of the remaining cancellation coils, said latter one cancellation coil being arranged at a position remote from said unbalancing member. The deflection yoke may comprise a truncated conical hollow core, a pair of saddle-shaped horizontal deflection coils and a pair of saddle-shaped vertical deflection coils, both, disposed inside said core, or may comprise a truncated conical hollow core and a pair of toroidal vertical deflection coils wound on said core. Two cancellation coils may be provided, for example, symmetrically relative to a central axis of the deflection yoke, one above the front end section and the other below the front end section. The magnetic-flux-distribution-unbalancing member may comprise, for example, a magnetic shield plate or other magnetic coils.

When the horizontal deflection coils and cancellation coils are connected either in series or in parallel with each other or are connected to the side of a chassis and a horizontal deflection current is caused to flow through the horizontal deflection coils, the current is also allowed to flow through the cancellation coils so that magnetic fields are produced from the cancellation coils. The magnetic fields produced from these cancellation coils then reach the regions of magnetic fields produced from the front end sections of the corresponding horizontal deflection coils and also the regions of magnetic fields produced from the rear end sections of the corresponding horizontal deflection coils.

Here, the magnetic field produced from each cancellation coil is opposite in direction to those produced at the front and rear end sections of the corresponding horizontal deflection coil as viewed in the direction of vertical deflection. Therefore, the magnetic field produced from each cancellation coil may successfully cancel the magnetic fields produced respectively from the front and rear end sections of the corresponding horizontal deflection coil.

When a magnetic shield plate is attached to a video display, the magnetic field produced from each cancellation coils may be guided more toward the magnetic shield plate whose permeability is high. As a result, the state of the magnetic field produced from the cancellation coil is unbalanced, whereby the magnetic field can no longer cancel, with good balancing, the magnetic fields produced respectively from the front and rear end sections of the corresponding horizontal deflection coils.

To ensure well-balanced cancellation, the magnetic flux intensities of the respective cancellation coils are varied in the present invention whereby the occurrence of electromagnetic interference radiation can be effectively prevented.

Simultaneous suppression of the magnetic fields produced from the front and rear end sections of the horizontal deflection coils, which has not been achieved to date, can be attained by the deflection yoke according to the present invention. The deflection yoke can therefore sufficiently reduce electromagnetic interference radiation.

The deflection yoke assembly according to the present invention can compensate external magnetic influence such as that applied from a magnetic shield plate, said magnetic influence increasing electromagnetic interference radiation, by unbalancing the magnetic flux intensities from individual cancellation coils. It is therefore possible to effectively and simply reduce the intensity of electromagnetic interference radiation.

BRIEF DESCRIPTION OF THE DRAWINGS

The above and other objects, features and advantages of the present invention will become more apparent from the following description and the appended claims, taken in conjunction with the accompanying drawings, in which:

DETAILED DESCRIPTION OF THE INVENTION AND PREFERRED EMBODIMENTS

Figure 1:
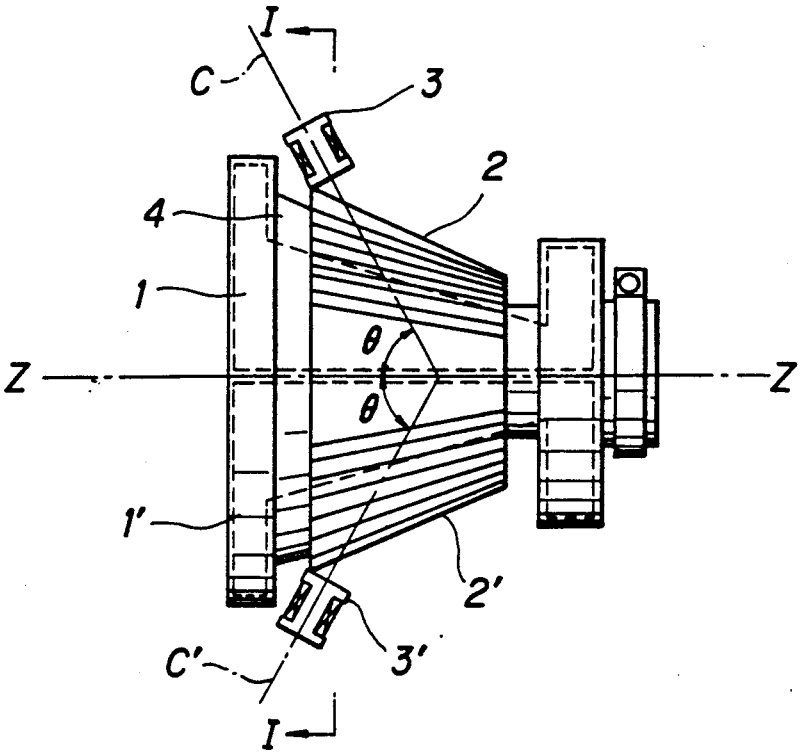
FIG. 1 is a schematic side view of a deflection yoke according to a first embodiment of the present invention.
Figure 2:
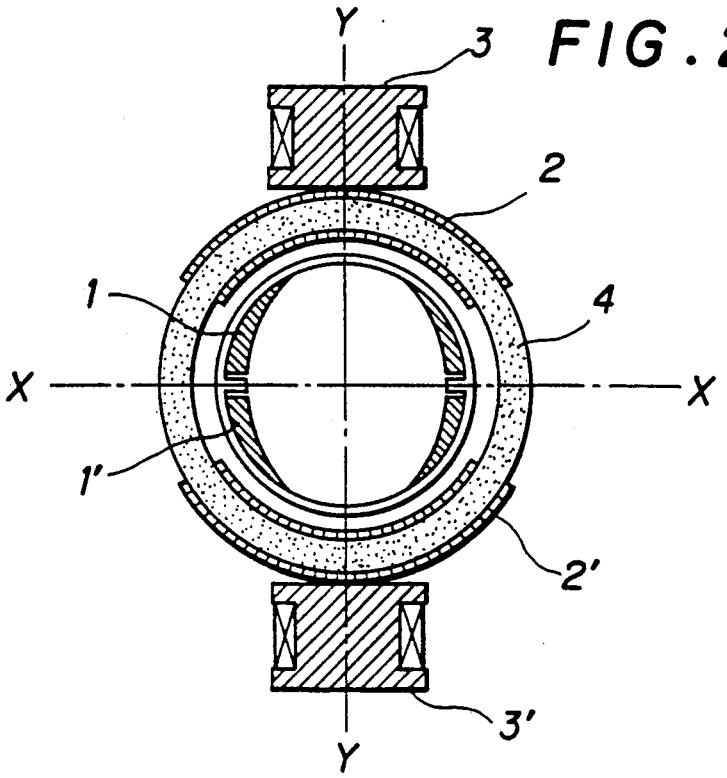
FIG. 2 is a cross-sectional view taken along line I—I of FIG. 1.
Figure 3:
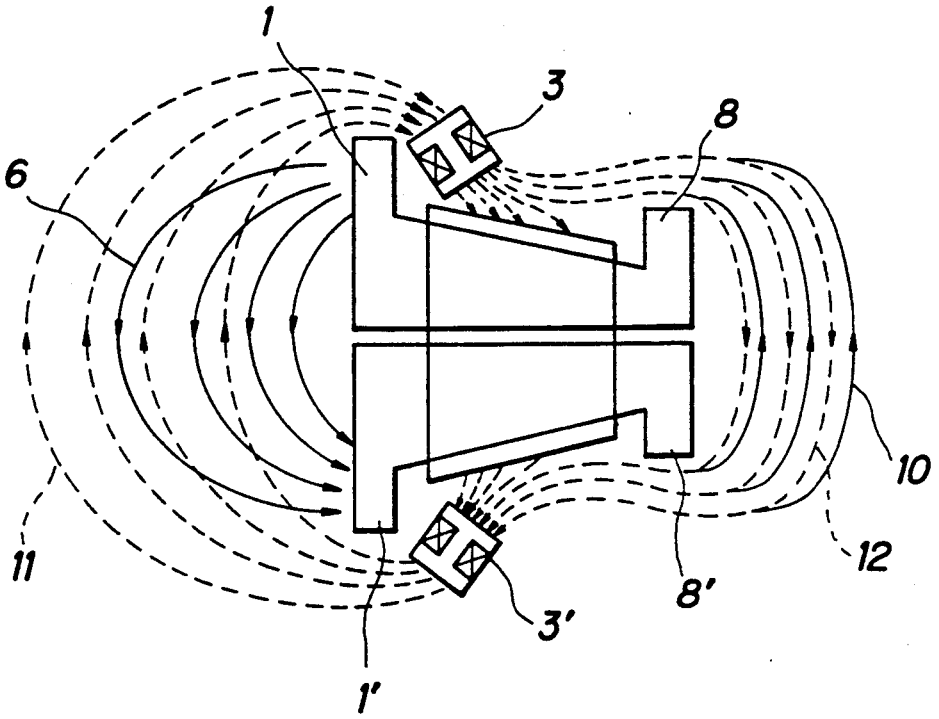
FIG. 3 illustrates cancellation effects for electromagnetic interference radiation by cancellation coils in the first embodiment.
Figure 9:
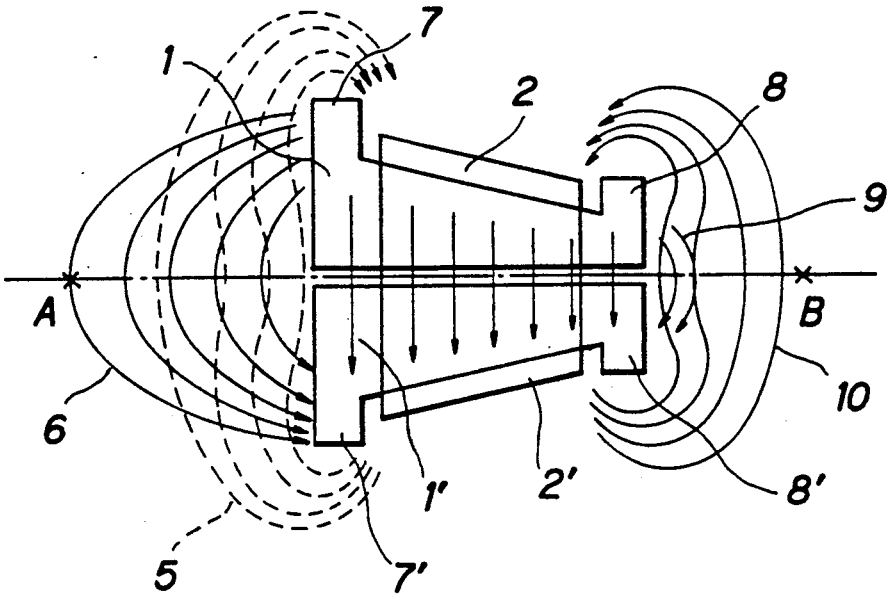
FIG. 9 is a schematic illustration showing the state of electromagnetic interference radiations from a deflection yoke.

Referring first to FIGS. 1 through 3, there are illustrated horizontal deflection coils 1,1', vertical deflection coils 2,2', cancellation coils 3,3', and a core 4.

As shown in these drawings, the saddle-shaped horizontal deflection coils 1,1' are disposed in a paired opposing relation inside the core 4 in a truncated conical hollow form. In addition, the vertical deflection coils 2,2' are wound in a pair and in a toroidal form on the core 4 in such a way that they oppose each other.

Assume that a central axis of the core 4, an axis in the direction of vertical deflection perpendicular to the central axis and an axis in the direction of horizontal deflection are represented by Z-axis, Y-axis and X-axis, respectively. Then, the horizontal deflection coils 1,1' are arranged symmetrically relative to X-axis, so are the vertical deflection coils 2,2'. The deflection yoke so constructed is fitted on an unillustrated cathode-ray tube. Therefore, the horizontal deflection coils 1,1' are disposed between the cathode-ray tube and the core 4.

The cancellation coils 3,3' are each wound on a magnetic body having a cylindrical or parallelepipedal shape and made of Mg-Zn ferrite for instance. As depicted in FIG. 1, the cancellation coil 3 is arranged in the vicinity of a front end section (end section on the screen side of the unillustrated cathode-ray tube) of the vertical deflection coil 2. The cancellation coil 3 is mounted in such a way that its central axis C crosses Z-axis at an angle $\theta$ and also Y-axis obliquely. On the other hand, the cancellation coil 3' is mounted in the vicinity of a front end section of the vertical deflection coil 2' with its central axis C' crossing Z-axis at the angle $\theta$ and also Y-axis obliquely. The cancellation coils 3,3' are therefore arranged at symmetrical positions with respect to X-axis and Y-axis.

These cancellation coils 3,3' are connected either in series or in parallel with the horizontal deflection coils 1,1', respectively. Accordingly, a horizontal deflection current of sawtooth waveform or a portion thereof is allowed to flow through the cancellation coils 3,3' whereby magnetic fields are produced.

Function of the cancellation coils 3,3' will next be described with reference to FIG. 3. Since the cancellation coils 3,3' are arranged as described above, by setting the number of turns of each of the cancellation coils 3,3', the magnetic field produced from the cancellation coils 3,3' sufficiently extends to the region of a primary magnetic field 6 produced from the front end sections of the horizontal deflection coils 1,1' on the front side of the cathode-ray tube as indicated by dashed arrow marks On the other hand, on the rear side of the cathode-ray tube, as shown by dashed arrow marks 12, the magnetic field produced from the cancellation coils 3,3' sufficiently reach the region of a rear end fringe magnetic field 10 produced from rear end fringes of the horizontal deflection coils 1,1'. The winding directions of the coils in the cancellation coils 3,3' are chosen so that the direction of the magnetic field 11 becomes opposite to the direction of the primary magnetic field 6 and the direction of the magnetic field 12 becomes opposite to the direction of the rear end fringe magnetic field 10.

As depicted in the same drawing, the directions of the magnetic fields 11,12 produced from the cancellation coils 3,3' are opposite to each other with respect to the direction of vertical deflection. Further, they are also opposite in direction to the primary magnetic field 6 and the rear end fringe magnetic field 10, respectively.

It is therefore possible to cancel the primary magnetic field 6 and rear end fringe magnetic field 10 produced from the horizontal deflection coils 1,1' by the magnetic fields 11,12 produced from the cancellation coils 3,3', thereby bringing about the effect that electromagnetic interference radiation from the horizontal deflection coils 1,1' can be fully suppressed.

Incidentally, the angle of inclination (mounting angle) $\theta$ of the central axes C,C' of the cancellation coils 3,3' relative to Z-axis is sufficient when it is set in a range of 30°–65° relative to Z-axis as a reference (0°), although the angle varies more or less depending on the shape of the associated deflection yoke. For example, in the case of a 90° deflection yoke for 14" CRT, best results were obtained when the angle of inclination $\theta$ was around 45°. The cancellation effects do not vary considerably even when the arrangement of the cancellation coils 3,3' is somewhat modified.

This embodiment can also cancel electromagnetic interference radiations produced on the side of side walls of the core 4 because the cancellation coils 3,3' also produce magnetic fields there as depicted in FIG. 3.

Figure 4:
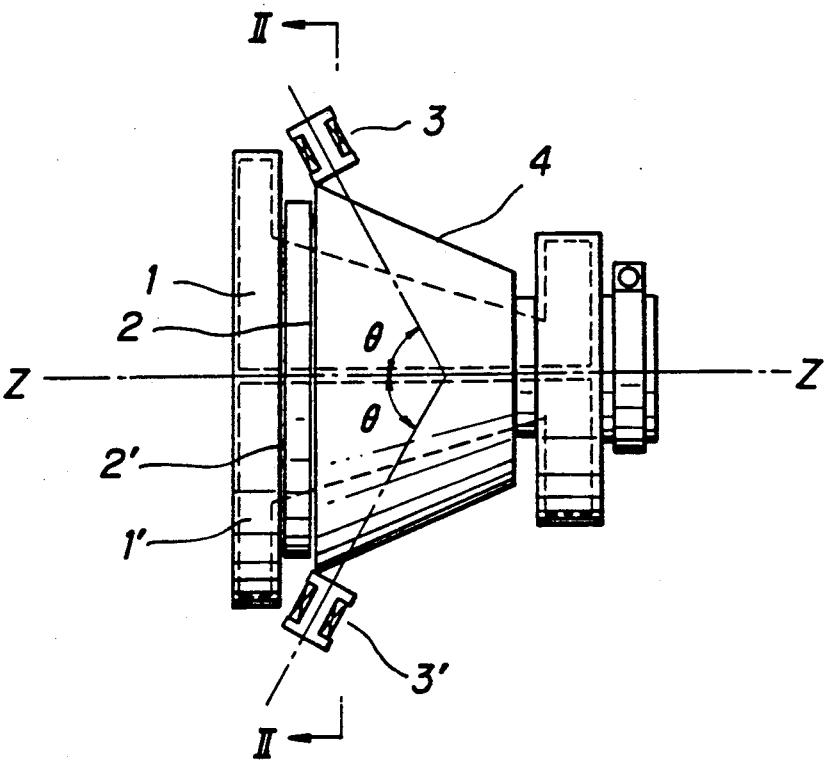
FIG. 4 is a schematic side view of a deflection yoke according to a second embodiment of the present invention.
Figure 5:
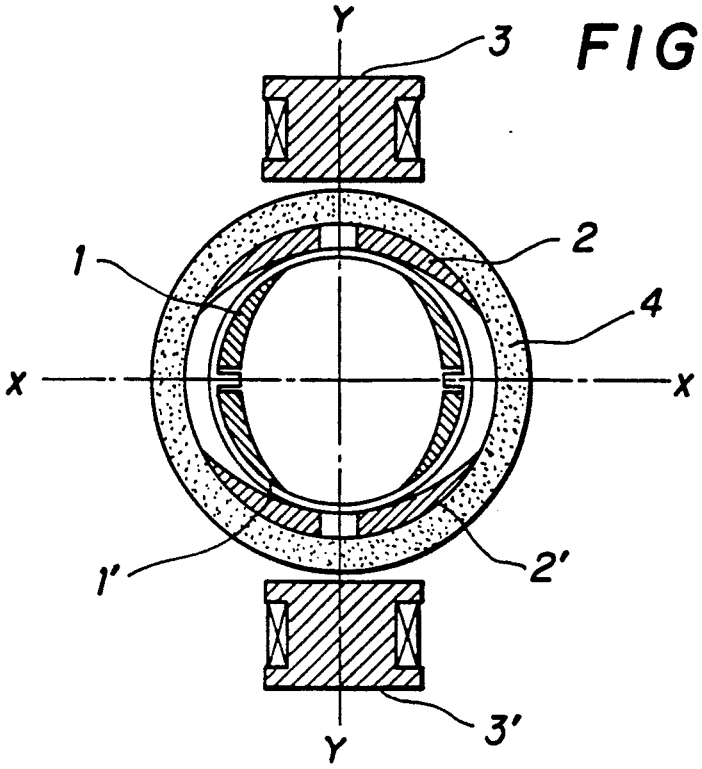
FIG. 5 is a cross-sectional view taken along line II—II of FIG. 4.

The deflection yoke according to the second embodiment of the present invention will next be described with reference to FIGS. 4 and 5.

In these drawings, there are shown horizontal deflection coils 1,1', vertical deflection coils 2,2', cancellation coils 3,3' and a core 4.

The second embodiment is different from the first embodiment in that coils wound in a saddle-like shape are used as the vertical deflection coils 2,2'. As depicted in these drawings, the vertical deflection coils 2,2 are disposed between the corresponding horizontal deflection coils 1,1' and the core 4.

Figure 6:
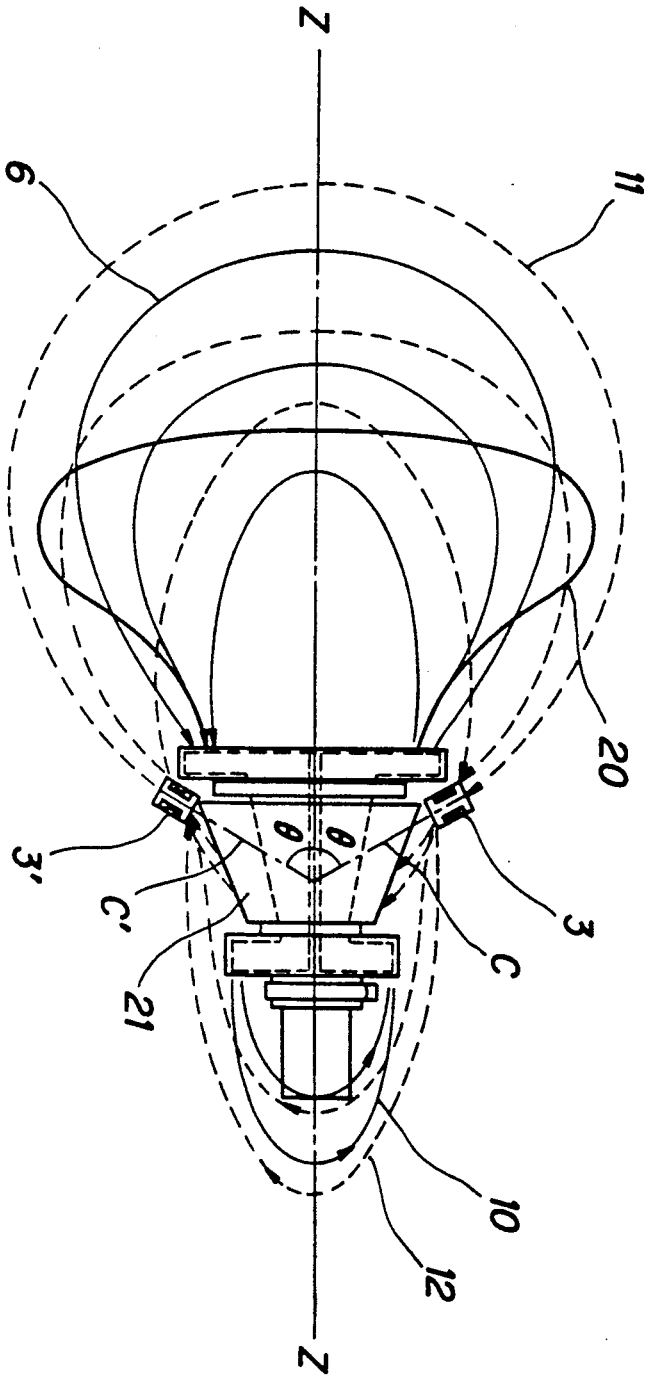
FIG. 6 is a schematic side view of a combination of a cathode-ray tube and a deflection yoke, which depicts the state of magnetic fields produced from the deflection yoke and the state of magnetic fields from cancellation coils where no magnetic shield plate is provided.
Figure 7:
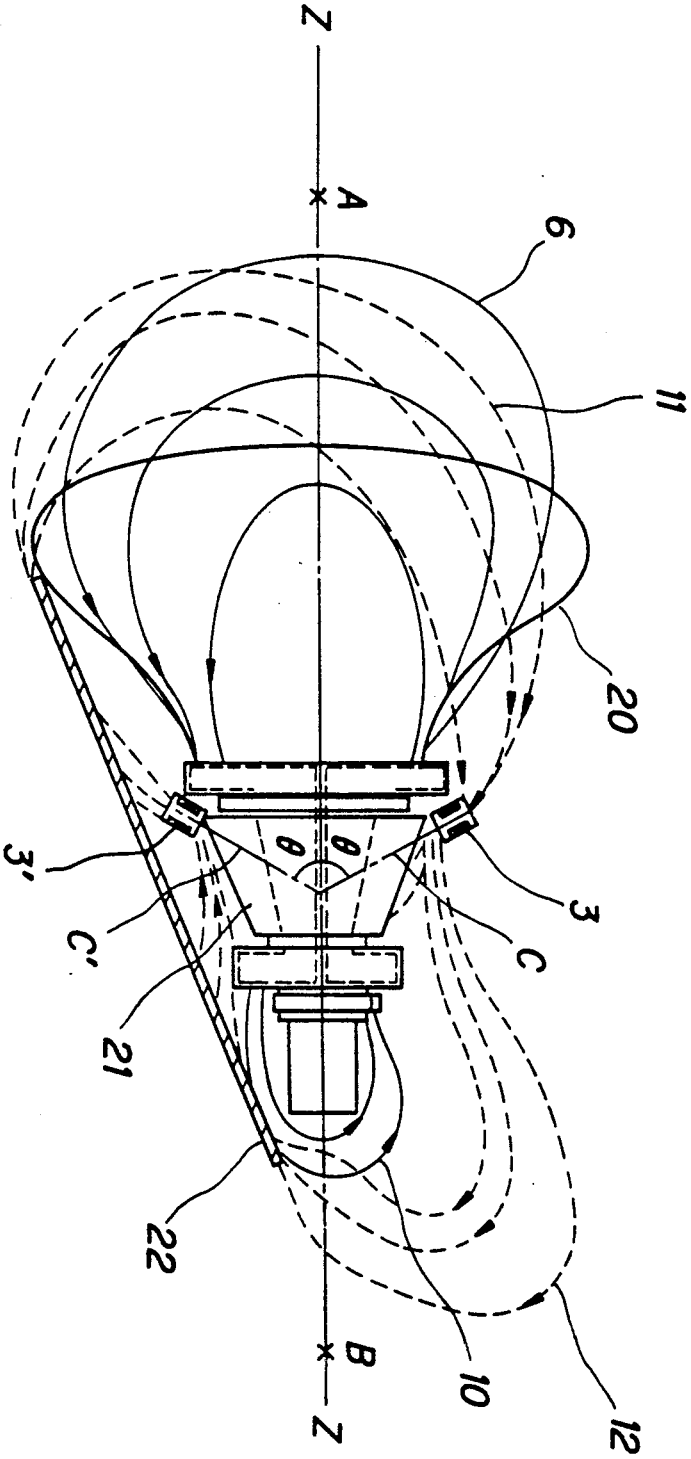
FIG. 7 illustrates the state of magnetic fields produced from the deflection yoke and the state of magnetic fields produced from the cancellation coils where a magnetic shield plate is additionally provided underneath the cathode-ray tube and deflection yoke of FIG. 6.
Figure 8:
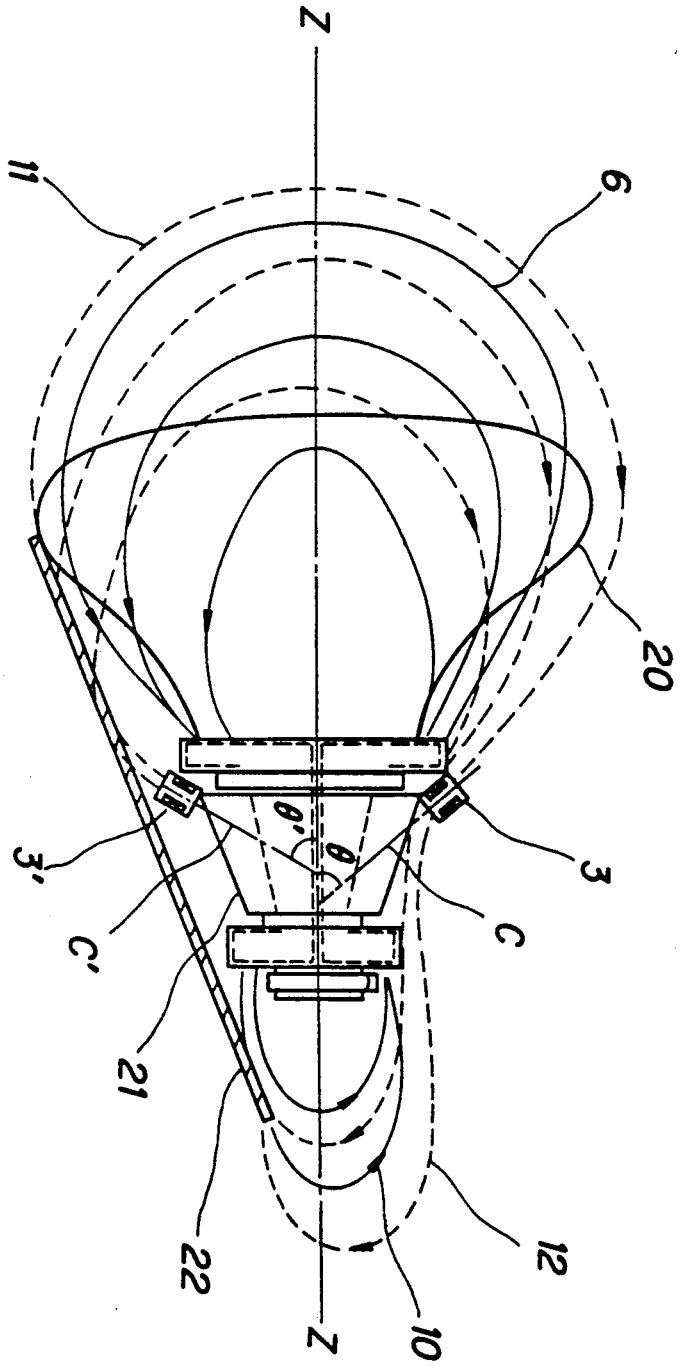
FIG. 8 depicts a third embodiment of the present invention, in which the intensities of magnetic fluxes produced respectively from upper and lower cancellation coils are unbalanced to compensate magnetic influence by a magnetic shield plate.

Reference is now had to FIGS. 6 through 8, which illustrate the third embodiment of the present invention.

In these drawings, there are illustrated cancellation coils 3,3', magnetic fields 6,10 produced from a deflection yoke 21, magnetic fields 11,12 produced from the cancellation coils 3,3', a cathode-ray tube 20, a deflection yoke 21, and a magnetic shield plate 22.

Because of the lack of any magnetic body such as magnetic shield plate around the cathode-ray tube 20 and deflection yoke 21 in the embodiment depicted in FIG. 6, the magnetic fields 11,12 produced from the cancellation coils 3,3' are symmetrical with respect to a central axis Z—Z of the deflection yoke 21. The front end and rear end magnetic fields 6,10 from the deflection yoke 21 can be canceled by the magnetic fields 11,12 produced from the cancellation coils 3,3', whereby the intensity of electromagnetic interference radiation can be reduced.

However, an actual video display is often covered by the magnetic shield plate 22 around the entire periphery of the video display or a part thereof so that magnetic fields produced from coils other than a deflection yoke may be reduced. When the magnetic shield plate is provided below the cathode ray tube 20 and deflection yoke 21 as shown in FIG. 7, the magnetic fields 11,12 from the cancellation coils 3,3' are affected substantially by the magnetic shield plate 22 because the cancellation coils 3,3' are attached outside the deflection yoke 21. As also depicted in the same drawing, the state of the magnetic fields 11,12 produced from the cancellation coils 3,3' are unbalanced vertically with respect to the central axis Z—Z of the deflection yoke 21.

As a consequence, the magnetic fields 6,10 from the deflection yoke 21 and the magnetic fields 11,12 from the cancellation coils 3,3' can no longer cancel each other at point A and point B on the front and rear sides of the cathode-ray tube, so that the intensity of electromagnetic interference radiation becomes great at certain locations.

To improve the above problem, it is possible to make the magnetic fields 6,10 from the front and rear end sections of the deflection yoke 21 have substantially similar shapes to the magnetic fields 11,12 from the cancellation coils 3,3' by making the magnetic flux intensity of the upper cancellation coil 3, which is disposed on the opposite side to the magnetic shield plate 22, higher than the magnetic flux intensity of the lower cancellation coil 3' disposed in the proximity of the magnetic shield plate 22. As a result, these magnetic fields can cancel each other to reduce the intensity of electromagnetic interference radiation.

A description will next be made of specific means for making higher the magnetic flux intensity of the upper cancellation coil 3 than that of the lower cancellation coil 3'.

(Specific Example 1)

The number of turns (n) of the upper cancellation coil 3 is made greater than the number of turns (n') of the lower cancellation coil 3' ($n' < n$).

(Specific Example 2)

As illustrated in FIG. 8, the mounting angle $\theta$ of the upper cancellation coil 3 is made smaller than the mounting angle $\theta'$ of the lower cancellation coil 3', both, with respect to the central axis Z—Z of the deflection yoke 21 ($\theta' = 45° > \theta = 30°$).

(Specific Example 3)

Both the upper and lower cancellation coils 3',3 are wound, for example, on parallelepipedal magnetic bodies or coil bobbins. By making different the longitudinal and/or transverse lengths of the coil bobbins for the upper and lower cancellation coils 3,3', the overall coil length (L) of the upper cancellation coil 3 can be made greater than the overall coil length (L') of the lower cancellation coil 3' ($L' < L$).

(Specific Example 4)

For example, the coil bobbin of the lower cancellation coil 3' is formed into a rectangular or square shape in cross-section while the coil bobbin of the upper cancellation coil 3 is formed into a trapezoidal shape in cross-section, so that the upper and lower cancellation coils 3',3 have different wound configurations As the cancellation coils, those formed by winding coils on magnetic bodies such as Mg-Zn ferrite or so-called coreless coils which do not use any magnetic body can be used by way of example. The former cancellation coils are more advantageous in that they require a smaller number of turns.

In each of the embodiments described above, two cancellation coils are provided, one above the deflection yoke and the other below the deflection yoke. The present invention is however not limited to this arrangement. Three or more cancellation coils can be arranged in combination or in pairs around the deflection yoke. When arranging cancellation coils symmetrically with respect to the central axis of the deflection yoke, they may be provided in a diagonally symmetrical relation with respect to the central axis of the deflection yoke.

As a magnetic-flux-distribution-unbalancing member arranged near the deflection coil to unbalance the state of distribution of magnetic fluxes produced from the cancellation coils, a magnetic shield plate was used in the third embodiment described above. The present invention is however not limited to the use of such an unbalancing member. Since the state of distribution of magnetic fluxes produced from cancellation coils can be unbalanced by providing a magnetic-field-producing member, for example, a magnetic coil such as a horizontal size control coil or linearity coil, the present invention can be applied to such a magnetic-flux-distribution-unbalancing member.

When such a magnetic coil is incorporated as a magnetic-flux-distribution-unbalancing member, it is necessary to make the magnetic flux intensity of the cancellation coil, which is arranged at the location remote from the magnetic coil, weaker than that of the cancellation coil disposed near the magnetic coil in contrast to the use of a magnetic shield plate.

As a specific means for controlling the magnetic flux intensities of the cancellation coils as described above, it can be achieved by making the number of turns of the cancellation coil, which is arranged the position remote from the magnetic coil, smaller than that of the cancellation coil disposed near the magnetic coil, the mounting angle of the former cancellation coil relative to the central axis of the deflection yoke greater than that of the latter cancellation coil, or the overall coil length of the former cancellation coil shorter than that of the latter cancellation coil, or by changing their shapes.

The provision of cancellation coils does not lead to a reduction in the productivity of deflection yokes because it is not necessary to strictly control the mounting accuracy of the cancellation coils.

We claim:

1. In a deflection yoke comprising a truncated conical hollow core, a pair of saddle-shaped horizontal deflection coils disposed inside said core, and a pair of toroidal vertical deflection coils wound on said core or a pair of vertical deflection coils wound in a saddle-like configuration and arranged in the vicinity of said core, the improvement wherein a pair of cancellation coils opposing each other on an imaginary axis which passes through a central axis of said core in the direction of vertical deflection are arranged near front end sections of said vertical deflection coils, respectively, a central axis of each of said cancellation coils is inclined at a predetermined angle relative to the central axis of said core, and said cancellation coils are connected with said horizontal deflection coils, respectively.

2. The yoke of claim 1, wherein each of said cancellation coils comprises a coil wound on a magnetic body.

3. The yoke of claim 1, wherein the central axis of each of said cancellation coils is inclined at an angle of 30°–65° relative to the central axis of said core.

4. In a deflection yoke assembly comprising in combination a deflection yoke with a core, a plurality of cancellation coils arranged near a front end section of said core to cancel magnetic fields produced from said front end section and a rear end section of said deflection yoke, and a magnetic-flux-distribution-unbalancing member disposed near said deflection yoke to unbalance the state of distribution of magnetic fluxes produced respectively from said cancellation coils, the improvement wherein at least one of said cancellation coils, said one cancellation coil being arranged in the vicinity of said unbalancing member, is different in magnetic flux intensity from at least one of the remaining cancellation coils, said latter one cancellation coil being arranged at a position remote from said unbalancing member.

5. The assembly of claim 4, wherein the core has a truncated conical hollow configuration and the deflection yoke comprises a pair of saddle-shaped horizontal deflection coils and a pair of saddle-shaped vertical deflection coils, all, arranged inside the core.

6. The assembly of claim 4, wherein the core has a truncated conical hollow configuration and the deflection yoke comprises a pair of toroidal vertical coils wound on the core.

7. The assembly of claim 4, wherein said cancellation coils are arranged above and below said deflection yoke, respectively.

8. The assembly of claim 4, wherein each of said cancellation coils comprises a coil wound on a magnetic body.

9. The assembly of claim 4, wherein said unbalancing member is a magnetic shield, and the magnetic flux intensity of said former one cancellation coil arranged in the vicinity of said magnetic shield is higher than that of said latter one cancellation coil arranged at the position remote from said magnetic shield.

10. The assembly of claim 4, wherein said unbalancing member is a magnetic coil, and the magnetic flux intensity of said latter one cancellation coil arranged at the position remote from said magnetic coil is made lower than that of said former one cancellation coil arranged in the vicinity of said magnetic shield when magnetic flux produced from the magnetic coil weakens magnetic fluxes produced respectively from said cancellation coils but is made higher than that of said former one cancellation coil when magnetic flux produced from said magnetic coil strengthens the magnetic fluxes produced respectively from said cancellation coils.

11. The assembly of claim 4, wherein said former one cancellation coil arranged in the vicinity of said unbalancing member is different in the number of turns from said latter one cancellation coil arranged at the position remote from said unbalancing member.

12. The assembly of claim 4, wherein said former one cancellation coil arranged in the vicinity of said unbalancing member is different in the mounting angle relative to a central axis of said deflection yoke from said latter one cancellation coil arranged at the position remote from said unbalancing member.

13. The assembly of claim 4, wherein said former one cancellation coil arranged in the vicinity of said unbalancing member is different in overall coil length from said latter one cancellation coil arranged at the position remote from said unbalancing member.

14. The assembly of claim 4, wherein said former one cancellation coil arranged in the vicinity of said unbalancing member is different in shape from said latter one cancellation coil arranged at the position remote from said unbalancing member.

* * * * *